US006273761B1

(12) United States Patent
Hsu et al.

(10) Patent No.: US 6,273,761 B1
(45) Date of Patent: Aug. 14, 2001

(54) JACK-PLUG SOCKET

(75) Inventors: Chang-Hsing Hsu, Pan Chiao; Mark Chen, Taipei, both of (TW)

(73) Assignee: Wieson Electronic Co., Ltd., Taipei Hsien (TW)

( * ) Notice: Subject to any disclaimer, the term of this patent is extended or adjusted under 35 U.S.C. 154(b) by 0 days.

(21) Appl. No.: 09/747,997

(22) Filed: Dec. 27, 2000

(51) Int. Cl.[7] ..... H01R 24/00
(52) U.S. Cl. ..... 439/676; 439/677
(58) Field of Search ..... 439/345, 385, 439/676, 677

(56) References Cited

U.S. PATENT DOCUMENTS

| | | | | |
|---|---|---|---|---|
| 6,142,834 | * | 11/2000 | Liao | 439/676 |
| 6,168,473 | * | 1/2001 | Hsin | 439/345 |
| 6,186,836 | * | 2/2001 | Ezawa et al. | 439/941 |
| 6,190,210 | * | 2/2001 | Belopolsky et al. | 439/676 |
| 6,217,391 | * | 4/2001 | Colantuono | 439/676 |

* cited by examiner

*Primary Examiner*—Khiem Nguyen
(74) *Attorney, Agent, or Firm*—Rosenberg, Klein & Lee

(57) ABSTRACT

An improved jack-plug socket which has a restraint means located in the socket which has a jack (connection slot) of a larger size for prohibiting phone (or Internet link) plugs of smaller size from inserting into the jack.

7 Claims, 8 Drawing Sheets

JACK-PLUG SOCKET

FIELD OF THE INVENTION

The present invention relates to an improved jack-plug socket and more particularly to a jack-plug socket that is capable of prohibiting smaller size plugs from inserting into a socket having a larger size jack.

BACKGROUND OF THE INVENTION

The commonly used telephone plug (as shown in FIGS. 1 and 2) and Internet link plug at present has to insert into a jack-plug socket to establish connection for communicating with other parties desired or accessing the Internet.

It happens occasionally that users have already inserted the phone plug or Internet link plug into the socket but could not get the connection or communication established. One of the causes of this problem is that a wrong plug has been used. There are generally two types of socket specification being adapted for the phone and Internet link nowadays. One type (socket 7, shown in FIG. 1) has a smaller size of jack 72 for connecting with a smaller size of plug 71. Another type (socket 8, shown in FIG. 2) has a larger size of jack 82 for connecting with a larger size of plug 81. The larger plug 81 cannot be inserted into the smaller jack 72 and won't cause problem. However the smaller plug 71 can be inserted into the larger jack 82 but cannot establish electric connection properly. Users might incidentally do so without awareness as the appearance of the plug 71 and 81 looks almost alike. As a result, the telephone does not work and Internet cannot be logged on. Users might confuse it with telephone disorder or Internet network malfunction. It is an annoying problem yet to be resolved.

SUMMARY OF THE INVENTION

In view of aforesaid disadvantages, it is therefore an object of this invention to provide an improved jack-plug socket that has a restrain means built in the socket for prohibiting the phone or Internet link plugs of smaller size from inserting into the sockets of larger size jacks.

Another object of this invention is to add an actuating means in the socket for restoring the restrain means to its initial position after operation is completed.

One still further object of the present invention is to shroud (or embed) the socket with a metal cover to prevent the socket from electric interference. The metal cover further may have an elastic strip for replacing the actuating means to save production cost and time.

One still further object of the present invention is to provide a spring between a free end of the socket and a ramp arm of the restrain means.

One still further object of the present invention is to provide a spring between the ramp arm of the restraint means and the inside wall of the metal cover.

One still further object of the present invention is to provide an elastic member at the top wall of the socket during plastics injection forming process with the elastic member located above a pivot spindle for providing a downward pressing force on the ramp arm.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENTS

Figure 1:
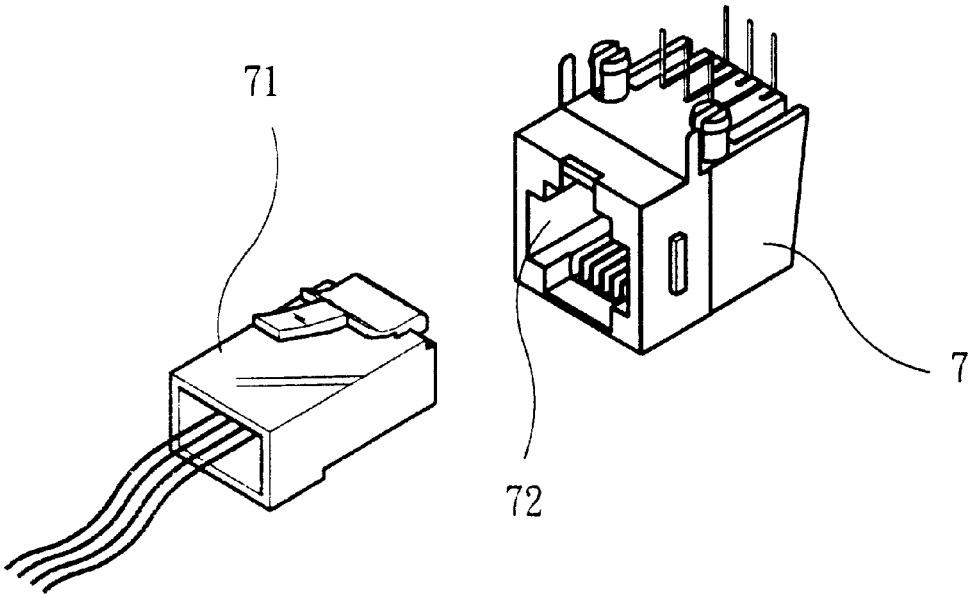
Fig. 1 prior art
FIG. 1 is a perspective view of a conventional jack-plug socket.
Figure 2:
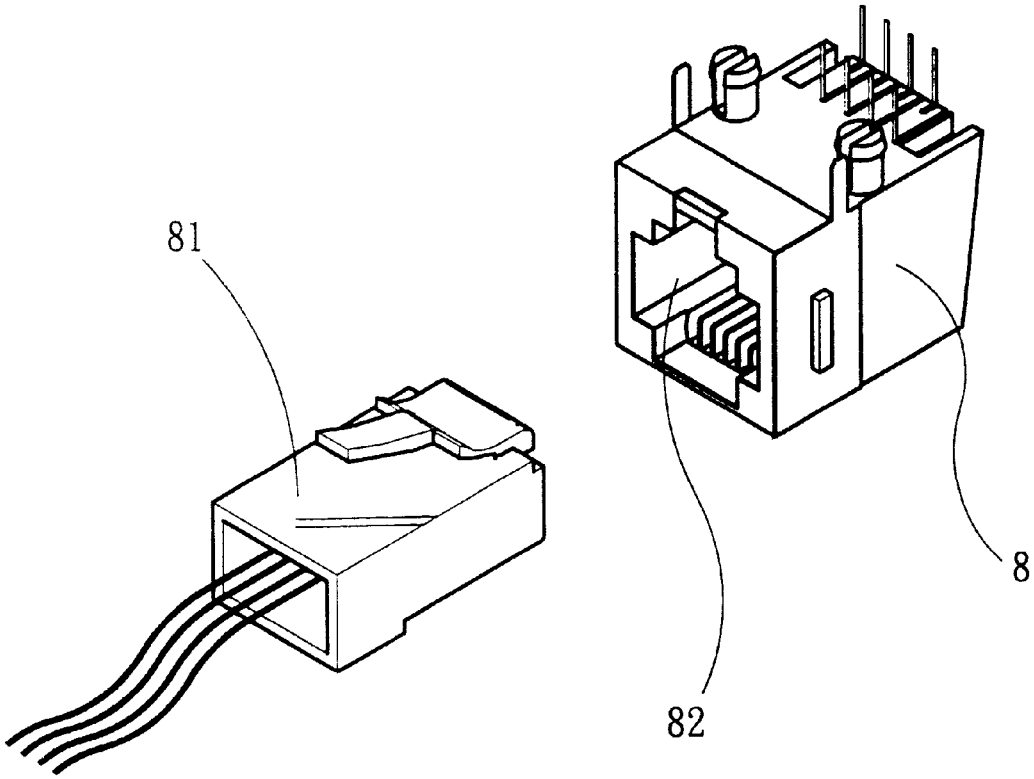
Fig. 2 prior art
FIG. 2 is a perspective view of another conventional jack-plug socket.
Figure 3:
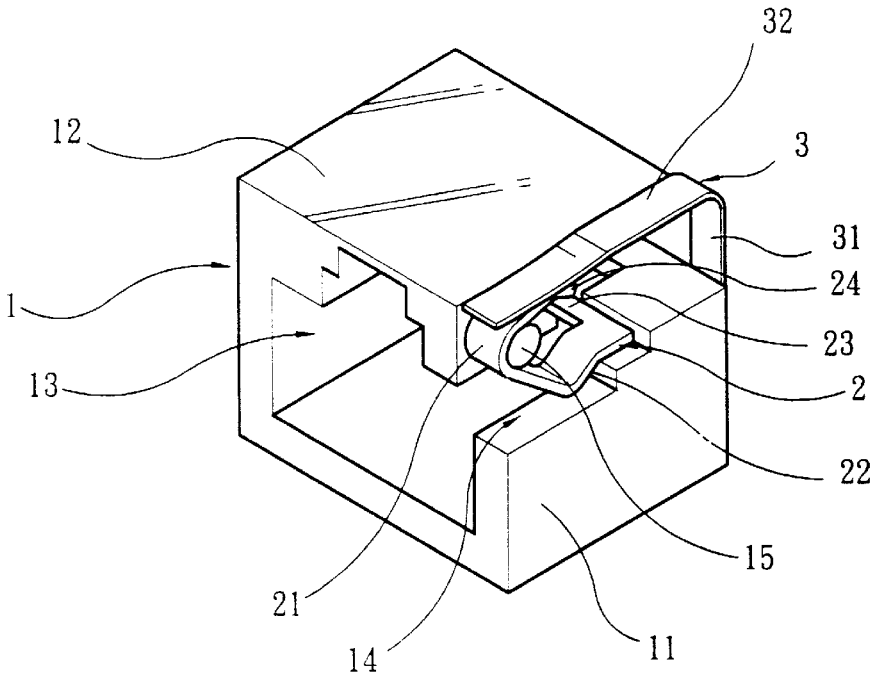
FIG. 3 is a perspective view of the present invention.
Figure 4:
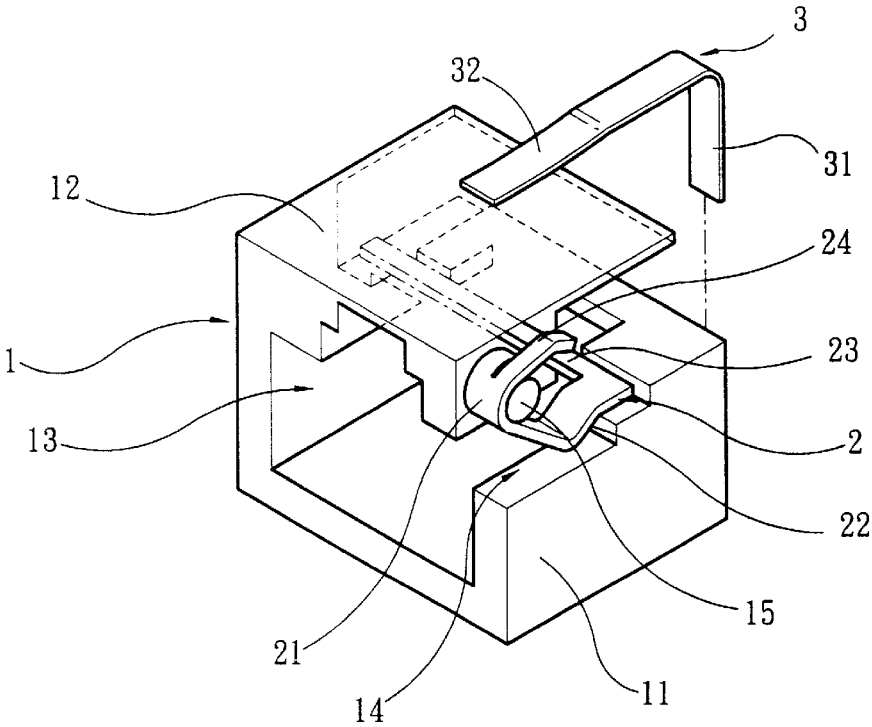
FIG. 4 is a partial exploded view of this invention according to FIG. 3.

Referring to FIGS. 3 and 4, the improved jack-plug socket according to this invention includes a body 1, a restain means 2 pivotally engaged with the body 1 and an actuating means 3 located at one side of the body 1, whereby to prohibit a smaller sized phone (or Internet link) plug from inserting into a larger sized jack of the socket.

The body 1 is made from a plastic material and includes a lower section 11 which has one side connecting with an upper section 12 thereof. Between the lower and upper section 11 and 12, there is a jack 13 for engaging with a phone plug (not shown in the figures). Another side of the upper and lower section 11 and 12 is a free end which has a gap 14 formed therebetween, which in turn enables an edge corner of the plug to pass through. At one side of the free end of the upper section 12, there is a pivot spindle 15.

The restrain means 2 is made of a metallic material and includes a pivot hub 21 pivotally engageable with the spindle 15 and has one end extended to become a ramp arm 22 and another end extended to become an upper arm 24. The ramp arm 22 connects with a stopping lever 23 which is extended transversely into the jack 13.

The actuating means 3 is made of a metallic material and has one end extended to form a leg 31 mounted on the body 1 and another end extended to form a press lever 32 located above the upper arm 24 and presses the upper arm 24. Thus form a complete socket of this invention.

Figure 5A:
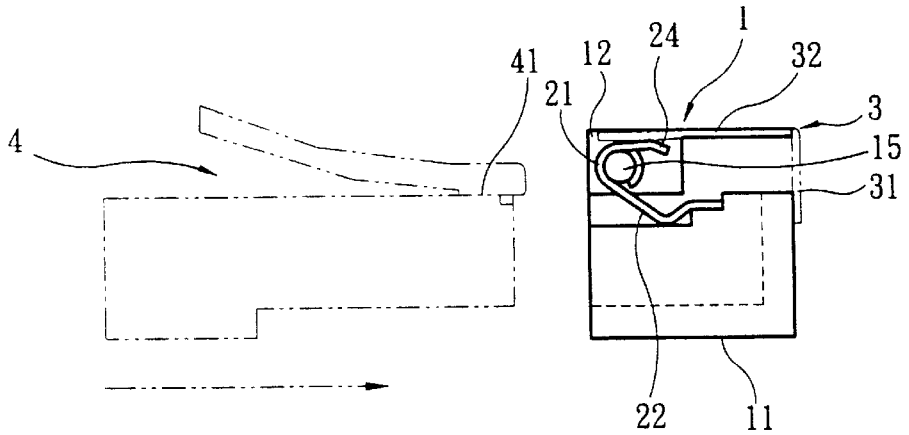
FIGS. 5A, 5B and 5C are schematic side views of the present invention in use, with a plug being inserted into the jack.
Figure 5B:
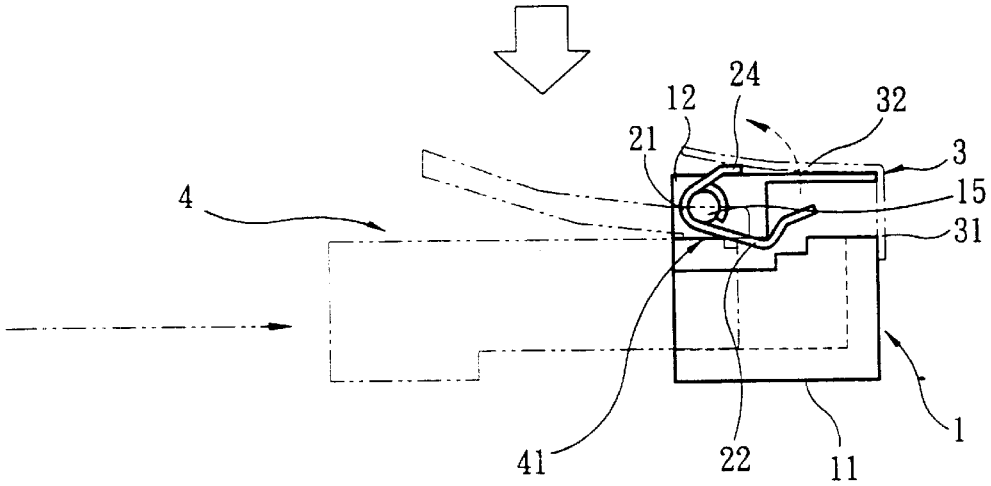
Figure 5C:
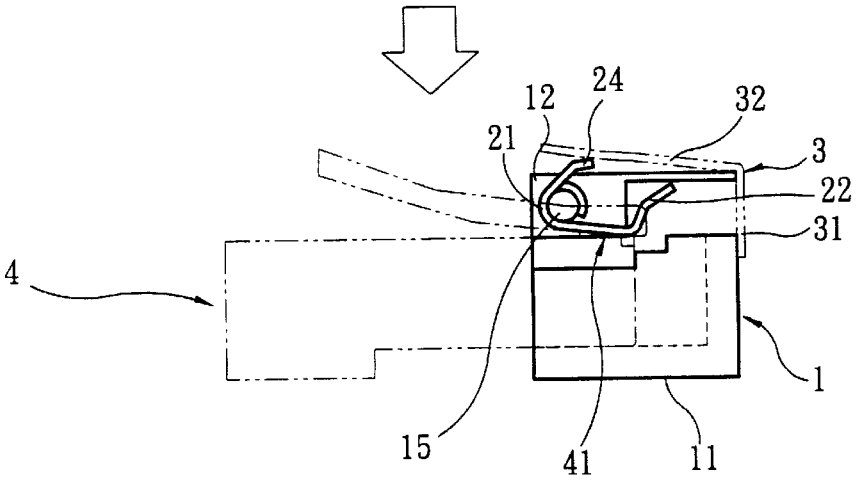

Referring to FIGS. 5A, 5B and 5C, when this invention in use, the phone plug 4 is inserted into the jack 13 of the body 1. The edge corner 41 of the plug 4 slides through the gap 14 and pushes against the bottom of the ramp arm 22. The ramp arm 22 is moved upward and turns about the spindle 15. In the mean time, the stopping lever 23 is moved upward, and the upper arm 24 also is moved upward to push the press lever 32 upward. Whereby the plug 4 will be inserted and held inside the jack 13 to engage with the body 1 securely for establishing communication link to transmit or receive signals.

When the plug is disengaged from the jack 13, the side corner 41 is moved away and separates from the ramp arm 22. The press lever 32 presses the upper arm 24 to move the ramp arm 22 and stopping lever 23 downward to their initial positions.

When a plug of a smaller size is inserted into the jack 13, its edge corner does not go through the gap 14. Consequently, the ramp arm 22 and stopping lever 23 won't be moved up. Hence the plug will be stopped by the stopping lever 23 from entering into the jack 13 fully. Users may recognize immediately that the plug is not fit for the socket.

The socket described above may be shrouded by or embedded with a metallic cover (not shown in the figures) to prevent the socket from electric interference.

Figure 6:
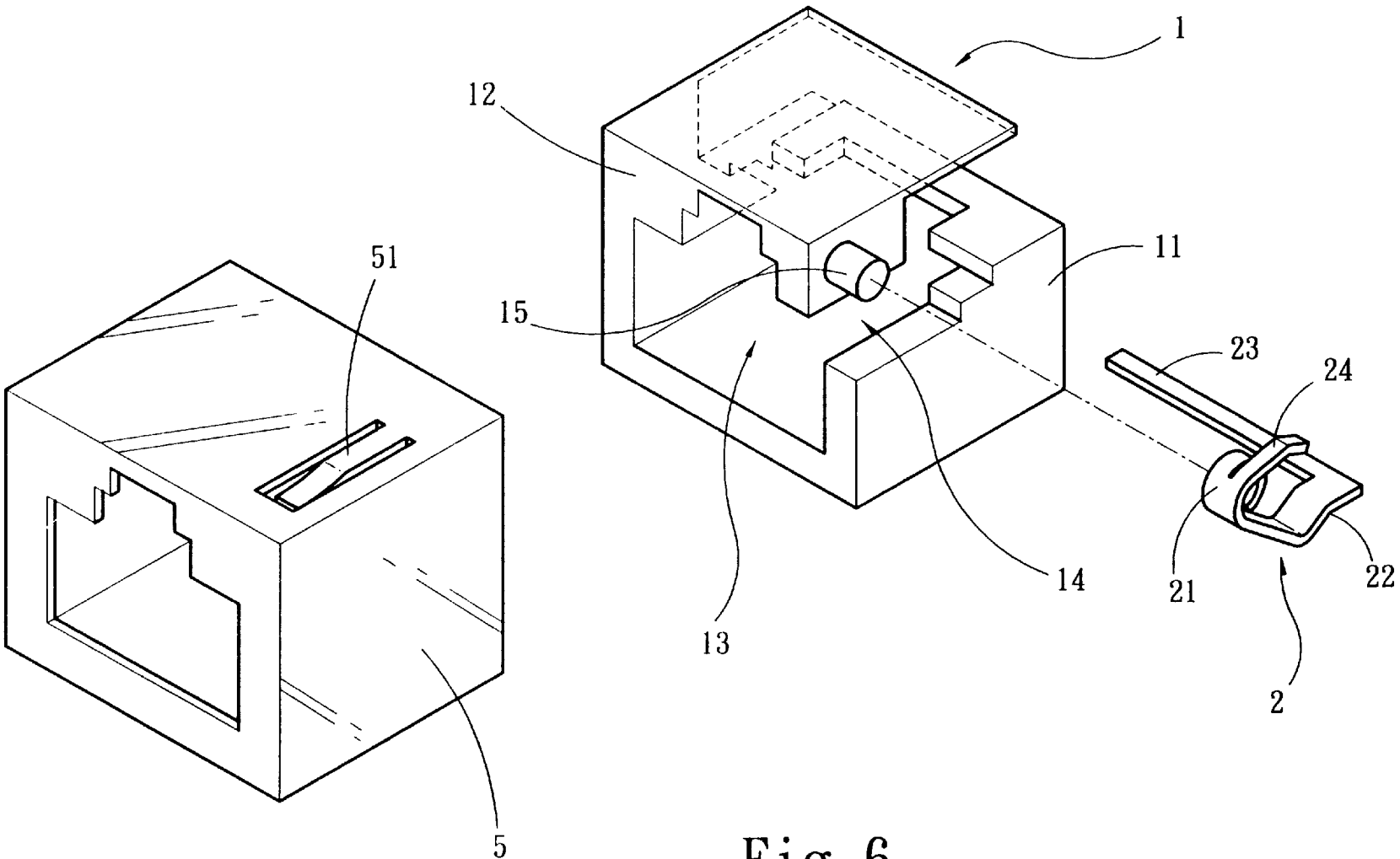
FIG. 6 is a perspective view of a first embodiment of the present invention.

Referring to FIG. 6 for the first embodiment of this invention, the socket is shrouded by a metallic cover 5 which also has an elastic strip 51 formed at the top wall thereof. The elastic strip 51 is located above and presses the upper arm 24. When the plug 4 is removed from the jack 13, the elastic strip 51 presses the upper arm 24 downward to make the ramp arm 22 and stopping lever 23 maintain at their initial positions. Such a design does not need the actuating means 3 and may save production time and cost.

Figure 7A:
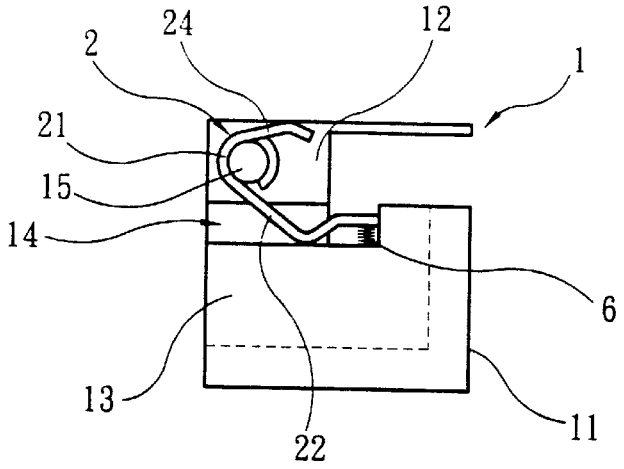
FIGS. 7A, 7B and 7C are schematic views of a second embodiment of the present invention.
Figure 7B:
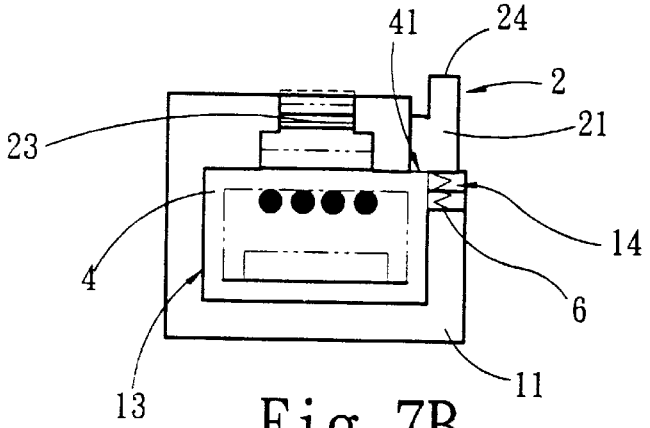
Figure 7C:
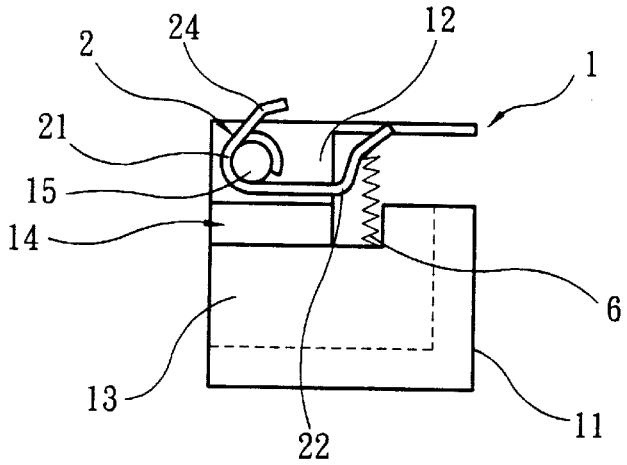

FIGS. 7A, 7B and 7C show the second embodiment of this invention. It is largely constructed like the one shown in FIG. 3. However the actuating means 3 is replaced by an elastic member 6 located between the ramp arm 22 and the free end of the lower section 11. When the plug 4 raises the ramp arm 22, the elastic member 6 is pulled to become an extension state. When the ramp arm 22 does not move up by the edge corner 41 of the plug 4, the elastic member 6 returns to a compression state for restoring the ramp arm 22 and stopping lever 23 to their initial positions.

Figure 8A:
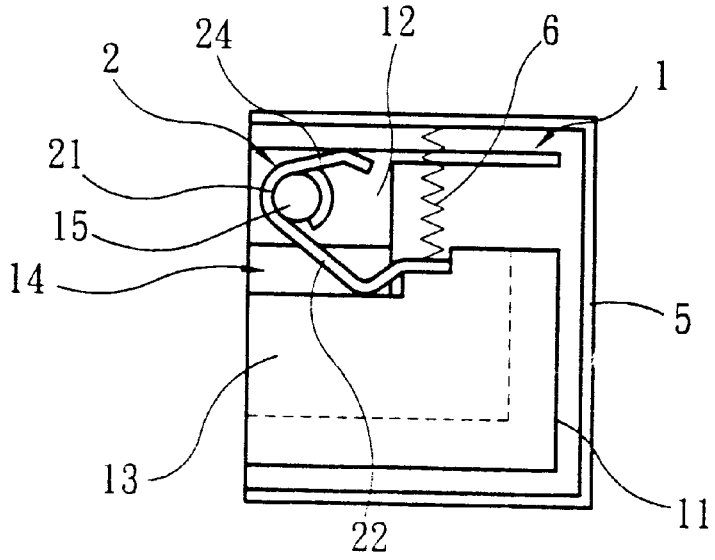
FIGS. 8A and 8B are schematic views of a third embodiment of the present invention.
Figure 8B:
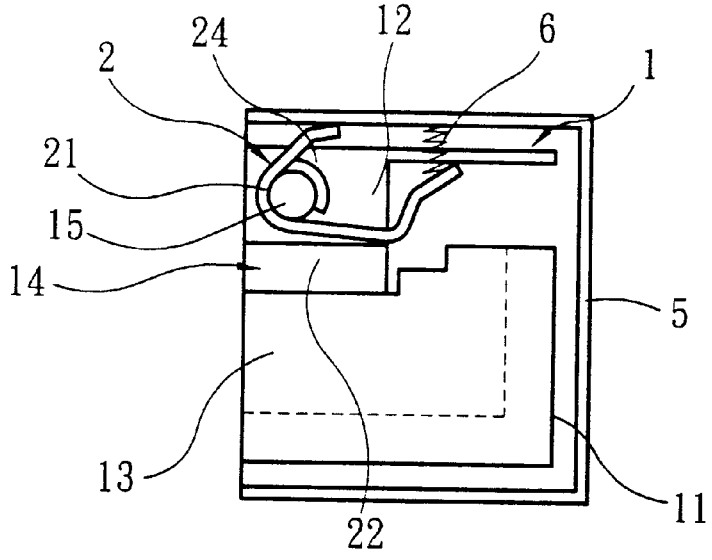

FIG. 8A and 8B show the third embodiment of this invention which is largely constructed like the one second embodiment shown in FIG. 7. However the elastic member 6 is located between the ramp arm 22 and inside wall of the metallic cover 5. When the ramp arm 22 is raised by the edge corner 41 of the plug 4, the elastic member 6 is at a compression state. When the ramp arm 22 is free from the pushing of the edge comer 41, the elastic member 6 extends and presses immediately the ramp arm 22 and topping lever 23 downward to their initial positions.

Figure 9:
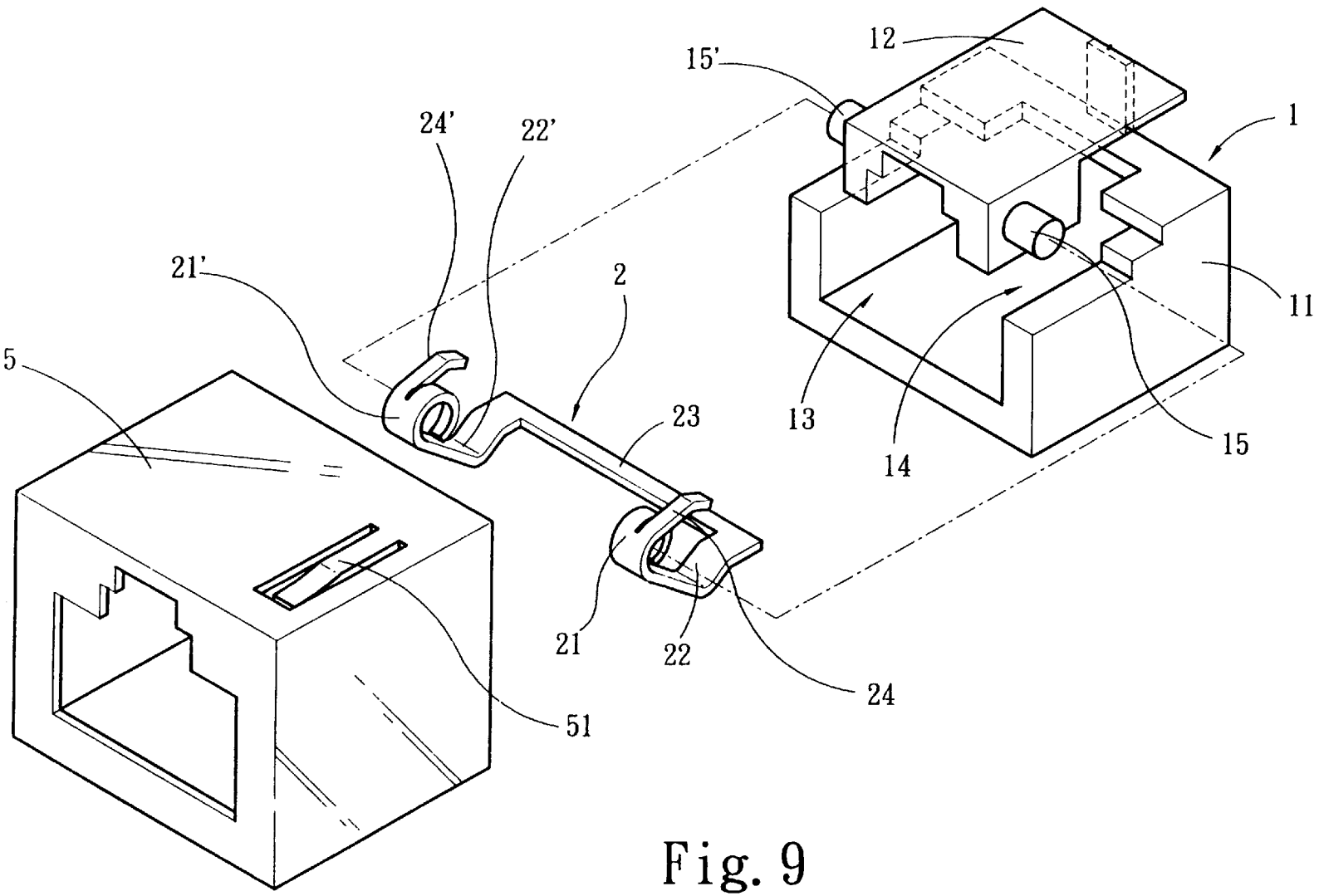
FIG. 9 is an exploded view of a fourth embodiment of the present invention.

Referring to FIG. 9 which shows the fourth embodiment of this invention. It is largely constructed like the first embodiment shown in FIG. 6. However the restrain means 2 has two sets of symmetrical pivot hub 21 and 21' which have respectively one end formed an upper arm 24 and 24', and another end formed a ramp arm 22 and 22'. The ramp arms 22 and 22' are bridged by a stopping lever 23 formed therebetween. The upper section 12 of the body 1 has two pivot spindles 15 and 15' located at two sides thereof engageable respectively with the pivot hubs 21 and 21'. Such a design may make the stopping lever 23 moving up or down more steadily.

Figure 10:
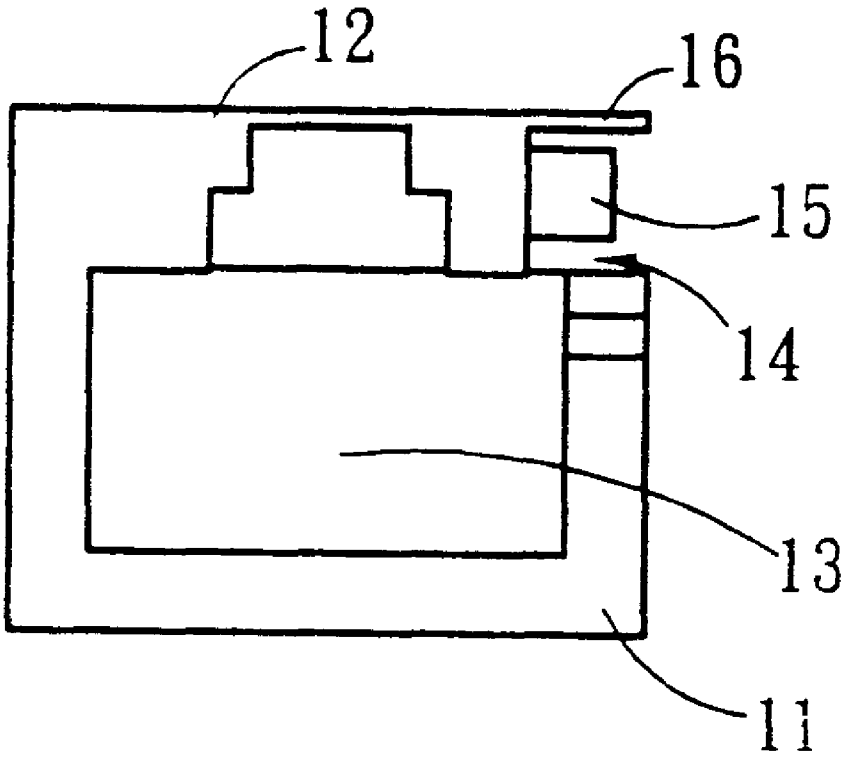
FIG. 10 is a schematic view of a fourth embodiment of the present invention.

Moreover, when the socket of this invention is formed by plastic injection molding process, any one of the free ends of the upper section 12 may be formed with a stopping tab 16 above the pivot spindle 15 (shown in FIG. 10 as the fifth embodiment). The stopping tab 16 has elasticity to press the upper arm 24 and ramp arm 22 downward when the ramp arm 22 is not moved up by the edge corner 41 of the plug 4. Hence a small size plug will be stopped by the stopping lever 23 from inserting into the jack 13, and when that happens users will be aware immediately that the plug is not fit for the socket.

While the present invention has been particularly shown and described with reference to preferred embodiments, it will be understood by those skilled in the art that various changes in form and detail may be without departing from the spirit and scope of the present invention.

What is claimed is:

1. An improved jack-plug socket for prohibiting a plug of a smaller size from inserting into a jack of a larger size, comprising:

a body having an upper section and a lower section which connect with each other at one side thereof and form the jack therebetween, and have respectively a free end at another side thereof forming a gap therebetween, the free end of the upper section having at least one end surface which has a pivot spindle located thereon;

a restrain means having a pivot hub pivotally engageable with the pivot spindle, the pivot hub having one end extended to form a ramp arm and another end extended to form an upper arm, the ramp arm having one end extended to form a stopping lever; and an actuating means having one end formed a leg attached to the body and another end thereof extended to form a press lever located above the upper arm;

wherein when the plug is inserted into the jack and passes through the gap, the ramp arm will be moved upward by the edge corner of the plug for moving the stopping lever and upper arm and press lever upward such that the plug will engage with the jack and body securely;

wherein when the plug is moved away from the jack, the edge corner is separated from the ramp arm and the press lever presses the upper arm for moving the ramp arm and stopping lever to their initial positions.

2. The improved jack-plug socket of claim 1, wherein the body is shrouded by a metallic cover.

3. The improved jack-plug socket of claim 1, wherein the actuating means is an elastic member in a form of a spring.

4. The improved jack-plug socket of claim 3, wherein the elastic member is located between the free end of the lower section and the ramp arm.

5. The improved jack-plug socket of claim 3, wherein the elastic member is located between the ramp arm and an inside wall of the metallic cover.

6. An improved jack-plug socket for prohibiting a plug of a smaller size from inserting into a jack of a larger size, comprising:

a body having an upper section and a lower section which connect with each other at one side thereof and form the jack therebetween, and have respectively a free end at another side thereof forming a gap therebetween, the free end of the upper section having at least one end surface which has a pivot spindle located thereon;

a restrain means having a pivot hub pivotally engaged with the pivot spindle, the pivot hub having one end extended to form a ramp arm and another end extended to form an upper arm, the ramp arm having one end extended to form a stopping lever; and a metal layer covering outside periphery of the body and having an elastic strip formed thereon, wherein when the plug is inserted into the jack and passes through the gap, the ramp arm will be moved upward by the edge corner of the plug for moving the stopping lever and upper arm and elastic strip upward such that the plug will engage with the jack and body securely;

wherein when the plug is moved away from the jack, the edge corner is separated from the ramp arm and the elastic strip presses the upper arm for moving the ramp arm and stopping lever downward to their initial positions.

7. An improved jack-plug socket for prohibiting a plug of a smaller size from inserting into a jack of a larger size, comprising:

a body having an upper section and a lower section which connect with each other at one side thereof and form the jack therebetween, and have respectively a free end at another side thereof forming a gap therebetween, the free end of the upper section having at least one end surface which has a pivot spindle and an elastic member located thereon; and a restrain means having a pivot hub pivotally engaged with the pivot spindle, the pivot hub having one end extended to form a ramp arm and another end extended to form an upper arm, the ramp arm having one end extended to form a stopping lever;

wherein when the plug is inserted into the jack and passes through the gap, the ramp arm will be moved upward by the edge corner of the plug for moving the stopping lever upward such that the plug will engage with the jack and body securely;

wherein when the plug is moved away from the jack, the edge corner is separated from the ramp arm and the elastic member presses the upper arm for moving the ramp arm and stopping lever downward to their initial positions.

* * * * *